US008290196B2

(12) United States Patent
Cheng et al.

(10) Patent No.: US 8,290,196 B2
(45) Date of Patent: Oct. 16, 2012

(54) SPEAKER MODULE APPLIED FOR A PORTABLE COMPUTER

(75) Inventors: Wen-Chieh Cheng, Taipei Hsien (TW); Chih-Yi Wang, Taipei Hsien (TW); Jung-Pin Kao, Taipei Hsien (TW)

(73) Assignee: Wistron Corporation, New Taipei (TW)

( * ) Notice: Subject to any disclaimer, the term of this patent is extended or adjusted under 35 U.S.C. 154(b) by 201 days.

(21) Appl. No.: 12/884,222

(22) Filed: Sep. 17, 2010

(65) Prior Publication Data

US 2011/0222720 A1 Sep. 15, 2011

(30) Foreign Application Priority Data

Mar. 12, 2010 (TW) ..... 99107229 A

(51) Int. Cl.
*H04R 1/02* (2006.01)

(52) U.S. Cl. ..... 381/387; 361/386

(58) Field of Classification Search ..... 381/335, 381/336, 386, 387; 361/629.27, 679.06, 361/679.23; 455/350, 351
See application file for complete search history.

(56) References Cited

U.S. PATENT DOCUMENTS 7,333,625 B2 * 2/2008 Jacobs et al. ..... 381/387
2002/0075636 A1 * 6/2002 Umetsu ..... 361/683

* cited by examiner

*Primary Examiner* — Brian Ensey
(74) *Attorney, Agent, or Firm* — Winston Hsu; Scott Margo

(57) ABSTRACT

A speaker module includes a casing whereon an opening is formed. The casing includes a blocking structure disposed on a side of the opening. The speaker module further includes a first speaker device, which includes a first housing, a first speaker unit disposed inside the first housing, and an engaging component connected to an end of the first housing for engaging with the blocking structure when the first housing is pulled out of the casing through the opening and for rotating relative to the blocking structure so as to adjust an angle of the first speaker unit. The speaker module further includes a second speaker device connected to the first speaker device and capable of passing through the opening, which includes a second housing connected to the first housing in a slidable manner relative to the first housing, and a second speaker unit disposed inside the second housing.

20 Claims, 6 Drawing Sheets

SPEAKER MODULE APPLIED FOR A PORTABLE COMPUTER

BACKGROUND OF THE INVENTION

1. Field of the Invention

The present invention relates to a speaker module applied for a portable computer, and more particularly, to a speaker module capable of hiding inside and exposing out of a portable computer.

2. Description of the Prior Art

With the application of a notebook computer, appearance and function of the notebook computer trends towards user's demand. For example, the appearance of the notebook computer trends towards a thin-typed structure, and a speaker trends towards a function of heavy bass acoustics. Due to the thin-typed structure, dimensions of components of the notebook computer are minimized according to design demand. However, dimensions of a speaker chamber affect exhaust space and acoustic quality, so that the speaker having high acoustic quality need have the chamber with predetermined dimensions. In manufacturing process of a conventional speaker with the heavy bass acoustics, the heavy bass speaker is vibrated by acoustic pressure. When the vibration is transmitted to structures around the heavy bass speaker, noise is generated to decrease acoustic quality of the heavy bass speaker, and resonance of other electronic components, such as a hard disk, is generated by the acoustic pressure. In addition, due to vibration of a diaphragm, a tolerance of structural space is designed for preventing the diaphragm from hitting internal structures of the notebook computer. For example, a worm slide sound box exposed out of the notebook computer is disclosed in TW patent no. 180767, which can solve a drawback of insufficient space of the chamber of the conventional notebook computer. However, it can not solve the problem that diaphragms of the different speaker units having corresponding acoustic ranges may hit with each other when vibrating. Thus, design of a mechanism having different speaker units with corresponding acoustic ranges and without interfering with each other and interfering to the internal structure of the notebook computer is an important issue of the speaker mechanical design.

SUMMARY OF THE INVENTION

The present invention provides a speaker module capable of hiding inside and exposing out of a portable computer for solving above drawbacks.

According to the claimed invention, a speaker module includes a casing whereon an opening is formed. The casing includes a blocking structure disposed on a side of the opening. The speaker module further includes a first speaker device disposed inside the casing and capable of passing through the opening on the casing. The first speaker device includes a first housing, a first speaker unit disposed inside the first housing for transforming an electrical signal from a circuit board into a sound signal, and an engaging component connected to an end of the first housing for engaging with the blocking structure of the casing when the first housing is pulled out of the casing through the opening and for rotating relative to the blocking structure so as to adjust an angle of the first speaker unit. The speaker module further includes a second speaker device connected to the first speaker device and capable of passing through the opening on the casing for disposing inside the casing. The second speaker device includes a second housing connected to the first housing in a slidable manner relative to the first housing, and a second speaker unit disposed inside the second housing for transforming the electrical signal from the circuit board into the sound signal.

According to the claimed invention, the engaging component is a rib protruding out of a lateral side of the end of the first housing, the blocking structure comprises a slot formed on an internal side of the casing for constraining the rib.

According to the claimed invention, the blocking structure comprises a rack formed around the opening, a sawtooth structure is respectively formed on the first housing and the second housing, and the rack constrains rotation of the sawtooth structure.

According to the claimed invention, a guiding structure disposed on the internal side of the casing for guiding the first housing to slide relative to the casing.

According to the claimed invention, a hook is formed on an end of the guiding structure for inserting into a hole on the first housing so as to fix the first speaker device inside the casing.

According to the claimed invention, the first speaker device further comprises a first handle portion connected to the other end of the first housing for pulling the first housing out of the casing.

According to the claimed invention, the first handle portion protrudes out of the side of the casing when the first housing is positioned inside the casing.

According to the claimed invention, the second speaker device further comprises a second handle portion pivoted to an end of the second housing for sliding the second housing relative to the first housing.

According to the claimed invention, a guiding slot is formed on the second housing, and a guiding track is formed on the first housing and disposed inside the guiding slot so as to slide the second housing relative to the first housing.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
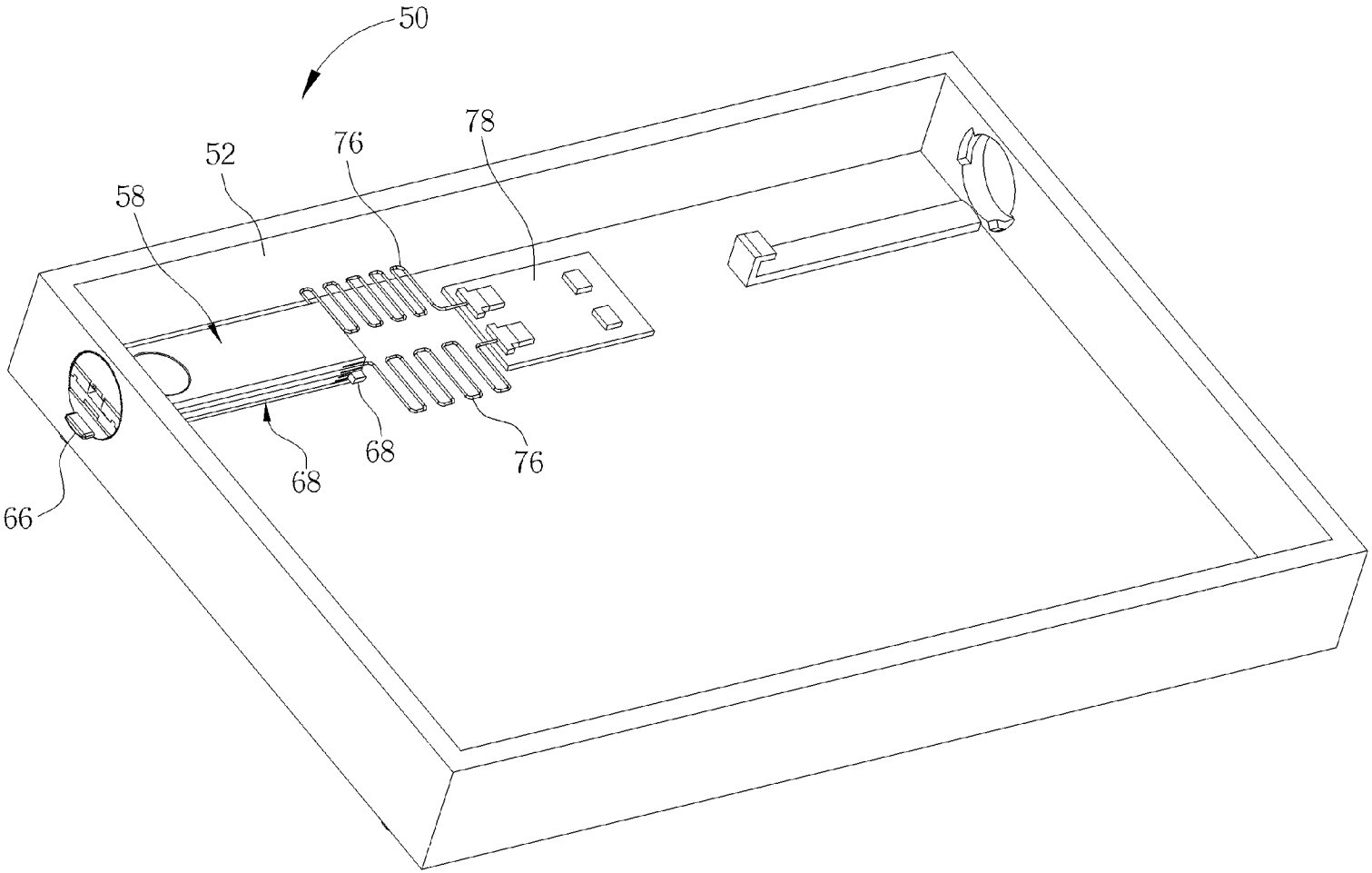
FIG. 1 is a schematic drawing of a speaker module installed in a portable computer according to a preferred embodiment of the present invention.
Figure 2:
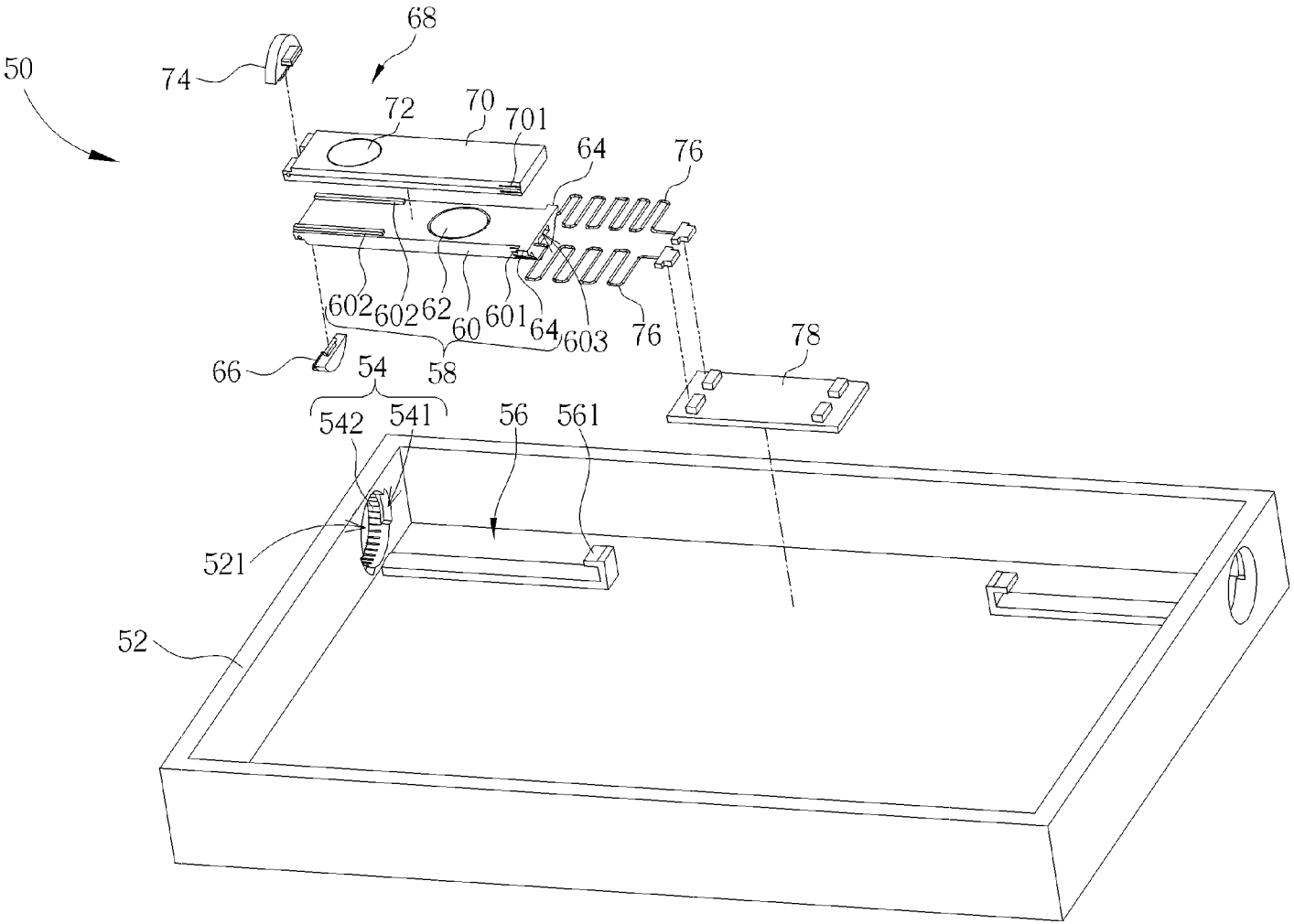
FIG. 2 is an exploded diagram of the speaker module according to the preferred embodiment of the present invention.

Please refer to FIG. 1 and FIG. 2. FIG. 1 is a schematic drawing of a speaker module 50 installed in a portable computer according to a preferred embodiment of the present invention. FIG. 2 is an exploded diagram of the speaker module 50 according to the preferred embodiment of the present invention. The portable computer can be a notebook computer, and the speaker module 50 can be installed on a side of the portable computer, or installed on two sides of the portable computer so as to have full-field sound effects. Positions and numbers of the speaker module 50 are not limited to this embodiment, and depend on design demand. The speaker module 50 includes a casing 52 whereon an opening 521 is formed. The casing 52 includes a blocking structure 54 disposed on a side of the opening 521. The blocking structure 54 can include at least one slot 541 formed on an internal side of the casing 52, and a rack 542 formed around the opening 521. In addition, a guiding structure 56 is disposed on the internal side of the casing 52. A hook 561 is formed on an end of the guiding structure 56. A top end of the guiding structure 56 is lower than a lower end of the blocking structure 54.

The speaker module 50 further includes a first speaker device 58 disposed inside the casing 52 and capable of passing through the opening 521 on the casing 52. The first speaker device 58 includes a first housing 60. The guiding structure 56 guides the first housing 60 to slide relative to the casing 52. A sawtooth structure 601 is disposed on the first housing 60 for engaging with the rack 542 of the blocking structure 54, so as to control rotation of the first housing 60 relative to the casing 52. At least one guiding track 602 is formed on the first housing 60. In this embodiment, two guiding tracks 602 are respectively disposed on two sides of the first housing 60. In addition, a hole 603 is formed on the first housing 60. When the first housing 60 is positioned inside the casing 52, the hook 561 of the guiding structure 56 can insert into the hole 603 on the first housing 60, so as to fix the first speaker device 58 inside the casing 52. The first speaker device 58 further includes a first speaker unit 62 disposed inside the first housing 60 for transforming an electrical signal into a sound signal. The first speaker device 58 further includes at least one engaging component 64 connected to an end of the first housing 60. In this embodiment, two engaging components 64 are respectively disposed on two sides of the end of the first housing 60. For example, the engaging component 64 can be a rib protruding out of the lateral side of the end of the first housing 60. The engaging components 64 engages with the slot 541 of the blocking structure 54 when the first housing 60 is pulled out of the casing 52 through the opening 521, so as to prevent the first housing 60 from being pulled out of the casing 52 through the opening 521. In addition, the engaging component 64 can rotate in the slot 541 of the blocking structure 54, so as to rotate relative to the blocking structure 54. Meanwhile, engagement of the sawtooth structure 601 of the first housing 60 and the rack 542 of the blocking structure 54 can control the rotation of the first housing 60 relative to the casing 52, so as to adjust an angle of the first speaker unit 62. Besides, the first speaker device 58 further includes a first handle portion 66 connected to the other end of the first housing 60 for pulling the first housing 60 out of the casing 52. The first handle portion 66 can be a handle. When the first housing 60 is positioned inside the casing 52, the first handle portion 66 can protrude out of the lateral side of the casing 52 so that a user can pull the first handle portion 66 conveniently.

Figure 3:
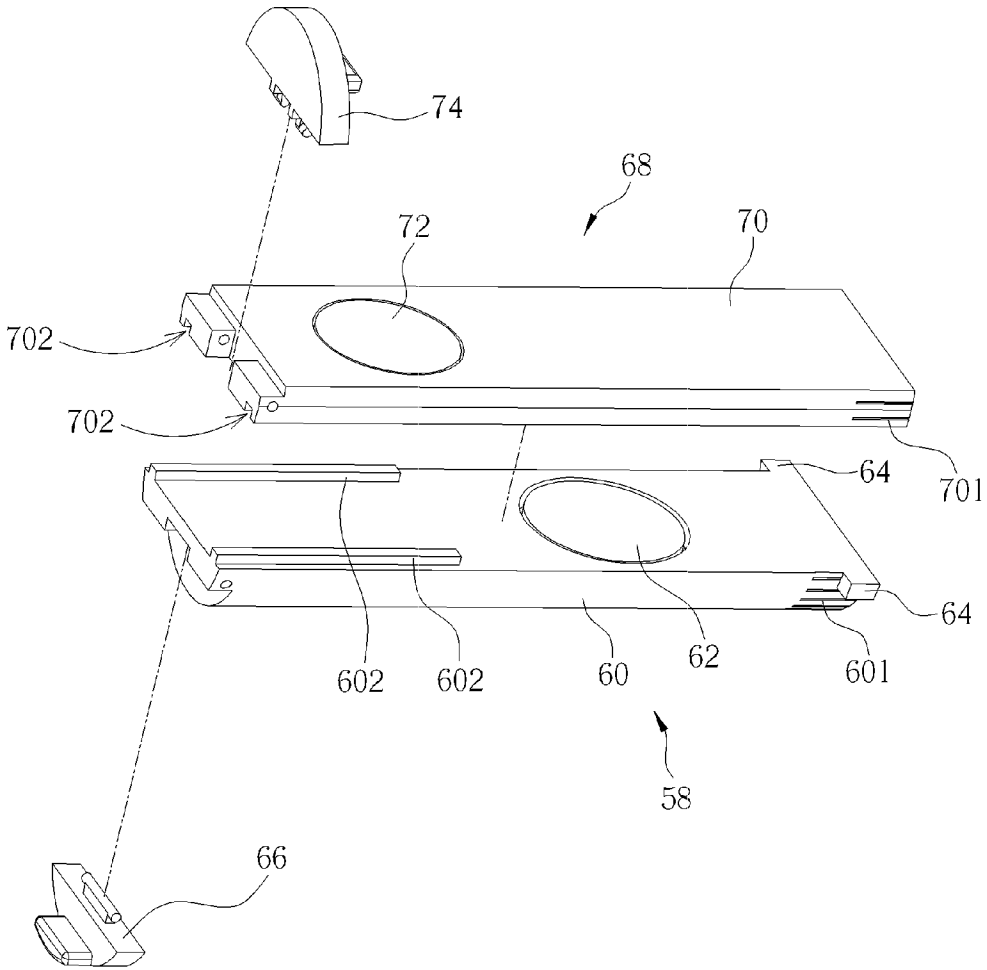
FIG. 3 is an enlarged diagram of a first speaker device and a second speaker device according to the preferred embodiment of the present invention.

The speaker module 50 further includes a second speaker device 68 connected to the first speaker device 58 in a movable manner and capable of passing through the opening 521 on the casing 52 for disposing inside the casing 52. Please refer to FIG. 2 and FIG. 3. FIG. 3 is an enlarged diagram of the first speaker device 58 and the second speaker device 68 according to the preferred embodiment of the present invention. The second speaker device 68 includes a second housing 70 connected to the first housing 60 in a slidable manner. A sawtooth structure 701 is disposed on the second housing 70 for engaging with the rack 542 of the blocking structure 54, so as to control rotation of the second housing 70 relative to the casing 52. At least one guiding slot 702 is formed on the second housing 70. In this embodiment, two guiding slots 702 are respectively disposed on two sides of the second housing 70 and on positions corresponding to the two guiding tracks 602 of the first housing 60, so that the guiding tracks 602 of the first housing 60 can be installed inside the guiding slots 702 of the second housing 70 in a slidable manner, and the second housing 70 can slide relative to the first housing 60. The second speaker device 68 further includes a second speaker unit 72 disposed inside the second housing 70 for transforming the electrical signal into the sound signal. In addition, the second speaker device 68 further includes a second handle portion 74 pivoted to an end of the second housing 70 for sliding the second housing 70 relative to the first housing 60. The second handle portion 74 can be a handle. When the second housing 70 is pulled to slide relative to the first housing 60, the second handle portion 74 can be rotated to a position substantially parallel to the second housing 70. Then the second handle portion 74 can pull the second housing 70 to slide relative to the first housing 60. Furthermore, when the second housing 70 is positioned inside the casing 52, the second handle portion 74 can be attached on the lateral side of the casing 52 for artistic appearance.

Figure 4:
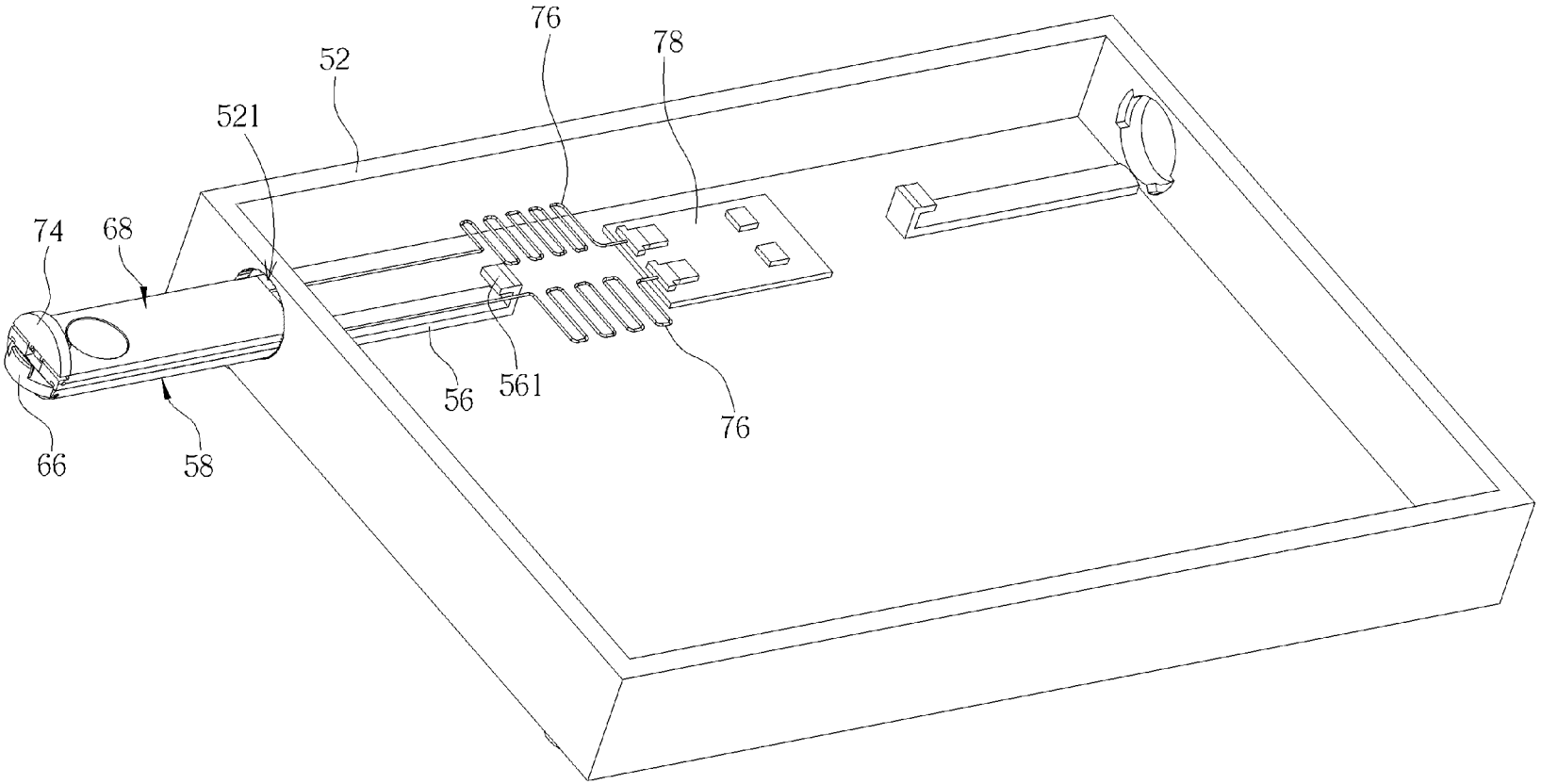
FIG. 4 to FIG. 6 are diagrams of the speaker module in different positions according to the preferred embodiment of the present invention.
Figure 5:
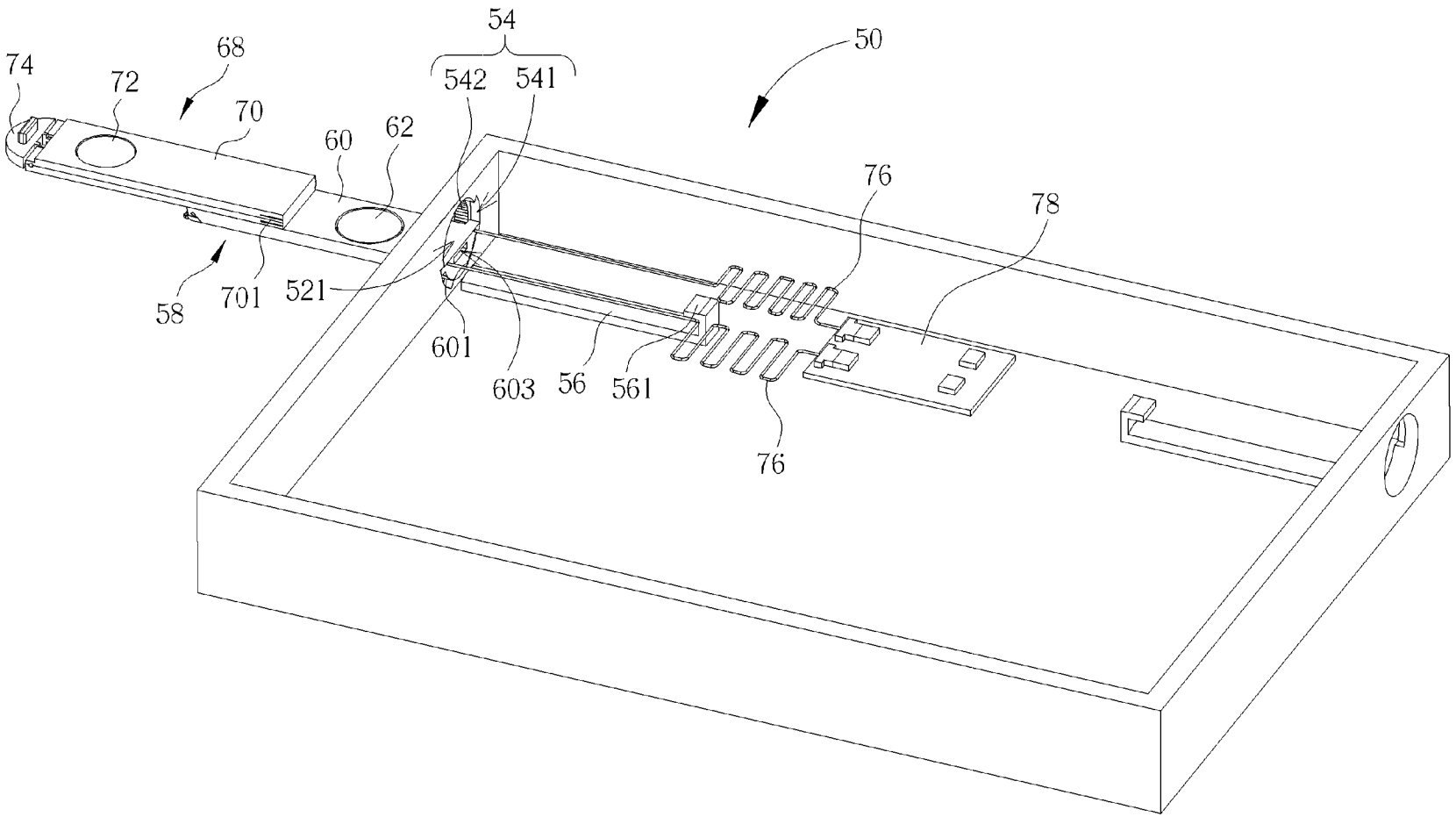
Figure 6:
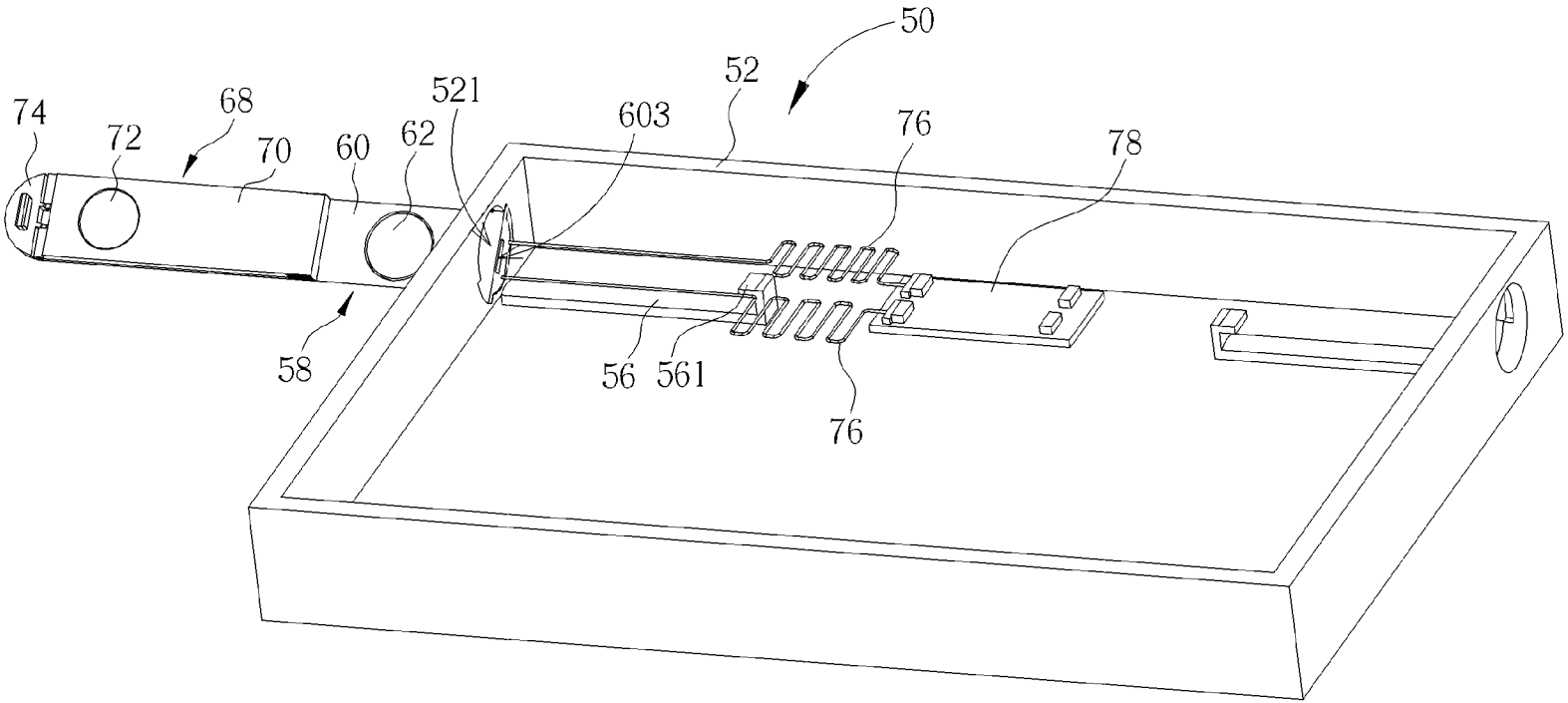

The first speaker device 58 and the second speaker device 68 can be electrically connected to a circuit board 78 via a cable 76, respectively, so as to transform the electrical signal from the circuit board 78 into the sound signal. The first speaker device 58 can preferably be a heavy bass speaker device or a general speaker device. The second speaker device 68 can be a general speaker device. Please refer to FIG. 1 to FIG. 6. FIG. 4 to FIG. 6 are diagrams of the speaker module 50 in different positions according to the preferred embodiment of the present invention. As shown in FIG. 1, when the first speaker device 58 and the second speaker device 68 are positioned inside the casing 52, the hook 561 of the guiding structure 56 can insert into the hole 603 on the first housing 60, so as to fix the first speaker device 58 and the second speaker device 68 inside the casing 52. As shown in FIG. 4, when the first speaker device 58 and the second speaker device 68 are pulled out of the casing 52 for playing the sound with different acoustic ranges, such as a normal range and a heavy bass range, the first handle portion 66 of the first speaker device 58 can be pulled for disengaging the hook 561 of the guiding structure 56 from the hole 603 on the first housing 60. Meanwhile, the first housing 60 can slide on the guiding structure 56 relative to the casing 52. When the first housing 60 is pulled out of the casing 52 through the opening 521, the second speaker device 68 connected to the first speaker device 58 can also be pulled out of the casing 52. The engaging component 64 engages with the slot 541 of the blocking structure 54 when the first housing 60 is pulled out of the casing 52 through the opening 521, which can prevent the first housing 60 from being out of the casing 52 through the opening 521. Because the top end of the guiding structure 56 is lower than the lower end of the blocking structure 54, combination of the first speaker device 58 and the second speaker device 68 has to be raised for disengaging the first housing 60 from the guiding structure 56, so as to pass the first speaker device 58 and the second speaker device 68 through the hole 521 on the casing 52 smoothly, and it can prevent the first speaker device 58 and the second speaker device 68 from being out of the casing 52 accidentally.

When the first speaker device 58 and the second speaker device 68 are pulled out of the casing 52, the second handle portion 74 can be rotated to a position substantially parallel to the second housing 70, and the second handle portion 74 can pull the second housing 70 to slide relative to the first housing 60, so as to unfold the combination of the first speaker device 58 and the second speaker device 68, as shown in FIG. 5.

Diaphragms of the first speaker unit 62 and the second speaker unit 72 can generate acoustics with optimized quality in an unconstrained status when the first speaker device 58 and the second speaker device 68 are pulled out of the portable computer. In addition, the first speaker unit 62 and the second speaker unit 72 can have respective switch functions. For example, when the first speaker unit 62 and the second speaker unit 72 are loaded into the casing 52, the speaker module 50 can start the speaker unit with the normal range. With demand of the heavy bass range, the first speaker device 58 and the second speaker device 68 can be pulled out of the casing 52, and then the combination of the first speaker device 58 and the second speaker device 68 can be unfolded to start the second speaker unit 72 for playing the heavy bass acoustics. Due to large vibration of the diaphragm of the speaker unit with heavy bass acoustics, tolerance between the heavy bass speaker and surrounding structures is necessary for preventing the diaphragm from hitting the surrounding structures. The present invention includes the second speaker unit 72 with heavy bass acoustics capable of being pulled out of the casing 52 and being separated from the other speaker unit, such as the first speaker unit 62, for reforming drawbacks of conventional speaker module. Furthermore, the speaker module 50 of the present invention utilizes a double-stack mechanism including the first speaker device 58 and the second speaker device 68. Layers of the stack mechanism are not limited to the above-mentioned embodiment, such as a multi-stack mechanism, and the detailed description is omitted herein for simplicity.

Besides, as shown in FIG. 6, when the first speaker device 58 and the second speaker device 68 are pulled out of the casing 52, the first speaker device 58 and the second speaker device 68 can be rotated for rotating the engaging component 64 inside the slot 541 of the blocking structure 54. Engagement of the sawtooth structure 601 of the first housing 60, the sawtooth structure 701 of the second housing 70, and the rack 542 of the blocking structure 54 can control the rotation of the first housing 60 and the second housing 70 relative to the casing 52, which means the blocking structure 54 blocks the sawtooth structure 601 of the first speaker device 58 and the sawtooth structure 701 of the second speaker device 68 slightly for positioning the rotation of the first speaker device 58 and the second speaker device 68, so as to adjust angles of the first speaker device 58 and the second speaker device 68.

Comparing to the prior art, the speaker module of the present invention can pull the speaker devices out of the portable computer, so that the diaphragms of the speaker units can generate optimized acoustics in a free space. In addition, the present invention can pull the speaker unit with the heavy bass range out of the casing for separating from the other speaker unit with the normal range, so as to improve limitation of the structural design due to the large vibration of the diaphragms, and to prevent the resonance of the speaker units and the other electronic components, such as a hard disk. Furthermore, the speaker module of the present invention utilizes the multi-stack mechanism for generating acoustics with various acoustic ranges.

Those skilled in the art will readily observe that numerous modifications and alterations of the device and method may be made while retaining the teachings of the invention.

What is claimed is:

1. A speaker module comprising:

a casing whereon an opening is formed, the casing comprising a blocking structure disposed on a side of the opening, the blocking structure comprising a slot formed on an internal side of the casing;

a first speaker device disposed inside the casing and capable of passing through the opening on the casing, the first speaker device comprising:

a first housing;

a first speaker unit disposed inside the first housing for transforming an electrical signal from a circuit board into a sound signal; and an engaging component connected to an end of the first housing for engaging with the blocking structure of the casing when the first housing is pulled out of the casing through the opening and for rotating relative to the blocking structure so as to adjust an angle of the first speaker unit, the engaging component being a rib protruding out of a lateral side of the end of the first housing, and the slot being for constraining the rib; and a second speaker device connected to the first speaker device and capable of passing through the opening on the casing for disposing inside the casing, the second speaker device comprising:

a second housing connected to the first housing in a slidable manner relative to the first housing; and a second speaker unit disposed inside the second housing for transforming the electrical signal from the circuit board into the sound signal.

2. The speaker module of claim 1, wherein the blocking structure comprises a rack formed around the opening, a sawtooth structure is respectively formed on the first housing and the second housing, and the rack constrains rotation of the sawtooth structure.

3. The speaker module of claim 1 further comprising:

a guiding structure disposed on the internal side of the casing for guiding the first housing to slide relative to the casing.

4. The speaker module of claim 3, wherein a hook is formed on an end of the guiding structure for inserting into a hole on the first housing so as to fix the first speaker device inside the casing.

5. The speaker module of claim 3, wherein a top end of the guiding structure is lower than a lower end of the blocking structure.

6. The speaker module of claim 1, wherein the first speaker device further comprises a first handle portion connected to the other end of the first housing for pulling the first housing out of the casing.

7. The speaker module of claim 6, wherein the first handle portion protrudes out of the side of the casing when the first housing is positioned inside the casing.

8. The speaker module of claim 1, wherein the second speaker device further comprises a second handle portion pivoted to an end of the second housing for sliding the second housing relative to the first housing.

9. The speaker module of claim 1, wherein a guiding slot is formed on the second housing, and a guiding track is formed on the first housing and disposed inside the guiding slot so as to slide the second housing relative to the first housing.

10. A speaker module comprising:

a casing whereon an opening is formed, the casing comprising a blocking structure disposed on a side of the opening, the blocking structure comprising a rack formed around the opening;

a first speaker device disposed inside the casing and capable of passing through the opening on the casing, the first speaker device comprising:

a first housing;

a first speaker unit disposed inside the first housing for transforming an electrical signal from a circuit board into a sound signal; and an engaging component connected to an end of the first housing for engaging with the blocking structure of the casing when the first housing is pulled out of the casing through the opening and for rotating relative to the blocking structure so as to adjust an angle of the first speaker unit; and a second speaker device connected to the first speaker device and capable of passing through the opening on the casing for disposing inside the casing, the second speaker device comprising:

a second housing connected to the first housing in a slidable manner relative to the first housing; and a second speaker unit disposed inside the second housing for transforming the electrical signal from the circuit board into the sound signal;

wherein a sawtooth structure is respectively formed on the first housing and the second housing, and the rack constrains rotation of the sawtooth structure.

11. The speaker module of claim 10 further comprising:

a guiding structure disposed on an internal side of the casing for guiding the first housing to slide relative to the casing.

12. The speaker module of claim 11, wherein a hook is formed on an end of the guiding structure for inserting into a hole on the first housing so as to fix the first speaker device inside the casing.

13. The speaker module of claim 11, wherein a top end of the guiding structure is lower than a lower end of the blocking structure.

14. The speaker module of claim 10, wherein the first speaker device further comprises a first handle portion connected to the other end of the first housing for pulling the first housing out of the casing.

15. The speaker module of claim 14, wherein the first handle portion protrudes out of the side of the casing when the first housing is positioned inside the casing.

16. The speaker module of claim 10, wherein the second speaker device further comprises a second handle portion pivoted to an end of the second housing for sliding the second housing relative to the first housing.

17. The speaker module of claim 10, wherein a guiding slot is formed on the second housing, and a guiding track is formed on the first housing and disposed inside the guiding slot so as to slide the second housing relative to the first housing.

18. A speaker module comprising:

a casing whereon an opening is formed, the casing comprising a blocking structure disposed on a side of the opening;

a first speaker device disposed inside the casing and capable of passing through the opening on the casing, the first speaker device comprising:

a first housing;

a first speaker unit disposed inside the first housing for transforming an electrical signal from a circuit board into a sound signal; and an engaging component connected to an end of the first housing for engaging with the blocking structure of the casing when the first housing is pulled out of the casing through the opening and for rotating relative to the blocking structure so as to adjust an angle of the first speaker unit;

a second speaker device connected to the first speaker device and capable of passing through the opening on the casing for disposing inside the casing, the second speaker device comprising:

a second housing connected to the first housing in a slidable manner relative to the first housing; and a second speaker unit disposed inside the second housing for transforming the electrical signal from the circuit board into the sound signal; and a guiding structure disposed on an internal side of the casing for guiding the first housing to slide relative to the casing, a hook being formed on an end of the guiding structure for inserting into a hole on the first housing so as to fix the first speaker device inside the casing.

19. The speaker module of claim 18, wherein a top end of the guiding structure is lower than a lower end of the blocking structure.

20. The speaker module of claim 18, wherein a guiding slot is formed on the second housing, and a guiding track is formed on the first housing and disposed inside the guiding slot so as to slide the second housing relative to the first housing.

* * * * *